US009803855B2

(12) United States Patent
Karkow et al.

(10) Patent No.: US 9,803,855 B2
(45) Date of Patent: Oct. 31, 2017

(54) SELECTABLE DILUTION LOW NOX BURNER

(71) Applicant: ClearSign Combustion Corporation, Seattle, WA (US)

(72) Inventors: Douglas W. Karkow, Des Moines, WA (US); Igor A. Krichtafovich, Kirkland, WA (US); Joseph Colannino, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 198 days.

(21) Appl. No.: 14/763,293

(22) PCT Filed: Feb. 14, 2014

(86) PCT No.: PCT/US2014/016626
§ 371 (c)(1),
(2) Date: Jul. 24, 2015

(87) PCT Pub. No.: WO2014/127306
PCT Pub. Date: Aug. 21, 2014

(65) Prior Publication Data

US 2015/0362178 A1 Dec. 17, 2015

Related U.S. Application Data

(60) Provisional application No. 61/765,022, filed on Feb. 14, 2013.

(51) Int. Cl.
*F23C 99/00* (2006.01)
*F23D 14/14* (2006.01)
(Continued)

(52) U.S. Cl.
CPC ..... *F23D 14/14* (2013.01); *F23C 5/08* (2013.01); *F23C 99/001* (2013.01); *F23D 14/20* (2013.01);
(Continued)

(58) Field of Classification Search
USPC ..... 431/253, 278, 115
See application file for complete search history.

(56) References Cited

U.S. PATENT DOCUMENTS 2,604,936 A 7/1952 Kaehni et al.
3,076,605 A 2/1963 Holden
(Continued)

FOREIGN PATENT DOCUMENTS

EP 0844434 5/1998
EP 1139020 8/2006
(Continued)

OTHER PUBLICATIONS

Fric, Thomas F., "Effects of Fuel-Air Unmixedness on NOx Emissions," Sep.-Oct. 1993. Journal of Propulsion and Power, vol. 9, No. 5, pp. 708-713.
(Continued)

*Primary Examiner* — Avinash Savani
(74) *Attorney, Agent, or Firm* — Christopher A. Wiklof; Nicholas S. Bromer; Launchpad IP, Inc.

(57) ABSTRACT

A burner supporting primary and secondary combustion reactions may include a primary combustion reaction actuator configured to select a location of the secondary combustion reaction. A burner may include a lifted flame holder structure configured to support a secondary combustion reaction above a partial premixing region. The secondary flame support location may be selected as a function of a turndown parameter. Selection logic may be of arbitrary complexity.

44 Claims, 7 Drawing Sheets

(51) Int. Cl.

| | |
|---|---|
| ***F23D 14/20*** | (2006.01) |
| ***F23D 14/74*** | (2006.01) |
| ***F23D 14/70*** | (2006.01) |
| ***F23D 14/84*** | (2006.01) |
| ***F23D 23/00*** | (2006.01) |
| ***F23C 5/08*** | (2006.01) |
| ***F23M 5/02*** | (2006.01) |

(52) U.S. Cl.

CPC ..... *F23D 14/70* (2013.01); *F23D 14/74* (2013.01); *F23D 14/84* (2013.01); *F23D 23/00* (2013.01); *F23M 5/025* (2013.01); *F23C 2200/00* (2013.01); *F23N 2037/02* (2013.01)

(56) References Cited

U.S. PATENT DOCUMENTS 3,167,109 A 1/1965 Wobig
3,224,485 A 12/1965 Blomgren, Sr. et al.
3,228,614 A 1/1966 Bauer
3,306,338 A 2/1967 Wright et al.
3,324,924 A 6/1967 Hailstone et al.
3,416,870 A 12/1968 Wright
3,687,602 A 8/1972 Vignes
3,749,545 A 7/1973 Velkoff
3,841,824 A 10/1974 Bethel
4,020,388 A 4/1977 Pratt, Jr.
4,021,188 A 5/1977 Yamagishi et al.
4,081,958 A 4/1978 Schelp
4,111,636 A 9/1978 Goldberg
4,397,356 A 8/1983 Retallick
4,408,461 A 10/1983 Bruhwiler et al.
4,673,349 A 6/1987 Abe et al.
4,752,213 A 6/1988 Grochowski et al.
4,899,696 A 2/1990 Kennedy et al.
5,235,667 A 8/1993 Canfield et al.
5,326,257 A 7/1994 Taylor et al.
5,441,402 A 8/1995 Reuther et al.
5,511,516 A 4/1996 Moore, Jr. et al.
5,667,374 A 9/1997 Nutcher et al.
5,713,206 A 2/1998 McWhirter et al.
5,784,889 A 7/1998 Joos et al.
5,846,067 A 12/1998 Nishiyama et al.
5,899,686 A 5/1999 Carbone et al.
5,957,682 A 9/1999 Kamal et al.
6,499,990 B1 12/2002 Zink et al.
7,137,808 B2 11/2006 Branston et al.
7,243,496 B2 7/2007 Pavlik et al.
7,360,506 B2 4/2008 Shellenberger et al.
7,523,603 B2 4/2009 Hagen et al.
8,082,725 B2 12/2011 Younsi et al.
8,851,882 B2 10/2014 Hartwick et al.
8,881,535 B2 11/2014 Hartwick et al.
8,911,699 B2 12/2014 Colannino et al.
9,062,882 B2 6/2015 Hangauer et al.
9,377,190 B2 6/2016 Karkow et al.
9,388,981 B2 7/2016 Karkow et al.
2002/0197574 A1* 12/2002 Jones ..... F23C 6/047 431/8
2004/0058290 A1 3/2004 Mauzey et al.
2004/0081933 A1 4/2004 St. Charles et al.
2005/0208442 A1 9/2005 Heiligers et al.
2006/0165555 A1 7/2006 Spielman et al.
2007/0020567 A1 1/2007 Branston et al.
2007/0292811 A1* 12/2007 Poe ..... F23D 14/08 431/116
2008/0124666 A1 5/2008 Stocker et al.
2008/0145802 A1 6/2008 Hammer et al.
2008/0268387 A1 10/2008 Saito et al.
2009/0111063 A1 4/2009 Boardman et al.
2011/0027734 A1 2/2011 Hartwick et al.
2011/0072786 A1 3/2011 Tokuda et al.
2011/0076628 A1 3/2011 Miura et al.
2011/0203771 A1 8/2011 Goodson et al.
2012/0135360 A1 5/2012 Hannum et al.
2012/0276487 A1 11/2012 Hangauer et al.
2013/0004902 A1 1/2013 Goodson et al.
2013/0071794 A1 3/2013 Colannino et al.
2013/0170090 A1 7/2013 Colannino et al.
2013/0230810 A1 9/2013 Goodson et al.
2013/0230811 A1 9/2013 Goodson et al.
2013/0255482 A1 10/2013 Goodson
2013/0255548 A1 10/2013 Goodson et al.
2013/0255549 A1 10/2013 Sonnichsen et al.
2013/0260321 A1 10/2013 Colannino et al.
2013/0291552 A1 11/2013 Smith et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0038113 A1 2/2014 Breidenthal et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Krichtafovitch et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0234786 A1 8/2014 Ruiz et al.
2014/0234789 A1 8/2014 Ruiz et al.
2014/0248566 A1 9/2014 Krichtafovitch et al.
2014/0251191 A1 9/2014 Goodson et al.
2014/0255855 A1 9/2014 Krichtafovitch
2014/0255856 A1 9/2014 Colannino et al.
2014/0272730 A1 9/2014 Krichtafovitch et al.
2014/0272731 A1 9/2014 Breidenthal et al.
2014/0287368 A1 9/2014 Krichtafovitch et al.
2014/0287376 A1 9/2014 Hultgren et al.
2014/0295094 A1 10/2014 Casasanta et al.
2014/0295360 A1 10/2014 Wiklof
2014/0335460 A1 11/2014 Wiklof et al.
2014/0338350 A1 11/2014 Breidenthal
2015/0079524 A1 3/2015 Colannino et al.
2015/0104748 A1 4/2015 Dumas et al.
2015/0107260 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.
2015/0241057 A1 8/2015 Krichtafovitch et al.
2015/0276211 A1 10/2015 Colannino et al.
2015/0276217 A1 10/2015 Karkow et al.
2015/0276220 A1 10/2015 Karkow et al.
2015/0285491 A1 10/2015 Karkow et al.
2015/0316261 A1 11/2015 Karkow et al.
2015/0330625 A1 11/2015 Karkow et al.
2015/0338089 A1 11/2015 Krichtafovitch et al.
2015/0345780 A1 12/2015 Krichtafovitch
2015/0345781 A1 12/2015 Krichtafovitch et al.
2015/0362177 A1 12/2015 Krichtafovitch et al.
2015/0369476 A1 12/2015 Wiklof
2015/0369477 A1 12/2015 Karkow et al.
2016/0003471 A1 1/2016 Karkow et al.
2016/0018103 A1 1/2016 Karkow et al.
2016/0025333 A1 1/2016 Karkow et al.

(56) References Cited

U.S. PATENT DOCUMENTS

| | | | |
|---|---|---|---|
| 2016/0025374 | A1 | 1/2016 | Karkow et al. |
| 2016/0025380 | A1 | 1/2016 | Karkow et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138799 | A1 | 5/2016 | Colannino et al. |
| 2016/0161110 | A1 | 6/2016 | Krichtafovitch et al. |
| 2016/0161115 | A1 | 6/2016 | Krichtafovitch et al. |
| 2016/0230984 | A1 | 8/2016 | Colannino et al. |
| 2016/0238240 | A1 | 8/2016 | Colannino et al. |
| 2016/0238242 | A1 | 8/2016 | Karkow et al. |
| 2016/0238277 | A1 | 8/2016 | Colannino et al. |
| 2016/0238318 | A1 | 8/2016 | Colannino et al. |
| 2016/0245507 | A1 | 8/2016 | Goodson et al. |
| 2016/0245509 | A1 | 8/2016 | Karkow et al. |
| 2016/0298840 | A1 | 10/2016 | Karkow et al. |

FOREIGN PATENT DOCUMENTS

| | | |
|---|---|---|
| EP | 2148137 | 1/2010 |
| FR | 2577304 | 12/1989 |
| GB | 1042014 | 9/1966 |
| JP | 60-216111 | 10/1985 |
| JP | 61-265404 | 11/1986 |
| WO | WO 95/00803 | 1/1995 |
| WO | WO 95/34784 | 12/1995 |
| WO | WO 2013/181569 | 12/2013 |
| WO | WO 2014/160830 | 10/2014 |
| WO | WO 2014/197108 | 12/2014 |
| WO | WO 2015/012872 | 1/2015 |
| WO | WO 2015/017084 | 2/2015 |
| WO | WO 2015/017087 | 2/2015 |
| WO | WO 2015/038245 | 3/2015 |
| WO | WO 2015/042566 | 3/2015 |
| WO | WO 2015/042615 | 3/2015 |
| WO | WO 2015/051136 | 4/2015 |
| WO | WO 2015/051377 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | PCT/US2015/038277 | 6/2015 |
| WO | WO 2015/089306 | 6/2015 |
| WO | PCT/US2015/040277 | 7/2015 |
| WO | WO 2015/103436 | 7/2015 |
| WO | WO 2015/112950 | 7/2015 |
| WO | WO 2015/123149 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2016/003883 | 1/2016 |
| WO | WO 2016/007564 | 1/2016 |
| WO | WO 2016/018610 | 2/2016 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/140681 | 9/2016 |
| WO | WO 2016/141362 | 9/2016 |

OTHER PUBLICATIONS

M. Zake et al., "Electric Field Control of NOx Formation in the Flame Channel Flows." Global Nest: The Int. J. May 2000, vol. 2, No. 1, pp. 99-108.

PCT International Search Report and Written Opinion of International PCT Application No. PCT/US2014/016626 mailed Jun. 3, 2014.

EPO Extended Search Report and Search Opinion of EP Application No. 14752039.9 mailed on Sep. 23, 2016.

Fric , Thomas F., "Effects of Fuel-Air Unmixedness on NOx Emissions," Sep.-Oct. 1993. Journal of Propulsion and Power, vol. 9, No. 5, pp. 708-713.

F. Altendorfner et al., Electric Field Effects on Emissions and Flame Stability with Optimized Electric Field Geometry, The European Combustion Meeting ECM 2007, 2007, 1-6, Germany.

Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.

M. Abdul Mujeebu et al., Applications of Porous Media Combustion Technology—A Review, Applied Energy, 2009, 1365-1375, Great Britain.

U.S. Appl. No. 14/878,391, filed Oct. 8, 2015, Colannino et al.

U.S. Appl. No. 14/061,477, filed Oct. 3, 2013, Krichtafovitch et al.

U.S. Appl. No. 14/827,390, filed Aug. 17, 2015, Wiklof et al.

U.S. Appl. No. 14/746,592, filed Jun. 22, 2015, Wiklof.

U.S. Appl. No. 14/845,681, filed Sep. 4, 2015, Krichtafovitch et al.

U.S. Appl. No. 14/931,020, filed Nov. 3, 2015, Dumas et al.

EPO Extended Search Report and Search Opinion of EP Application No. 14751185.1 mailed on Feb. 21, 2017.

* cited by examiner

SELECTABLE DILUTION LOW NOX BURNER

CROSS-REFERENCE TO RELATED APPLICATIONS

The present application is a U.S. National Phase application under 35 U.S.C. §371 of co-pending International Patent Application No. PCT/US2014/016626, entitled "SELECTABLE DILUTION LOW NOx BURNER," filed Feb. 14, 2014; which application claims the benefit of U.S. Provisional Patent Application No. 61/765,022, entitled "PERFORATED FLAME HOLDER AND BURNER INCLUDING A PERFORATED FLAME HOLDER," filed Feb. 14, 2013; each of which, to the extent not inconsistent with the disclosure herein, is incorporated herein by reference.

The present application is related to International Patent Application No. PCT/US2014/016628, entitled "PERFORATED FLAME HOLDER AND BURNER INCLUDING A PERFORATED FLAME HOLDER," filed Feb. 14, 2014; International Patent Application No. PCT/US2014/016632, entitled "FUEL COMBUSTION SYSTEM WITH A PERFORATED REACTION HOLDER," filed Feb. 14, 2014; and International Patent Application No. PCT/US2014/016622, entitled "STARTUP METHOD AND MECHANISM FOR A BURNER HAVING A PERFORATED FLAME HOLDER," filed Feb. 14, 2014; each of which, to the extent not inconsistent with the disclosure herein, are incorporated herein by reference.

BACKGROUND

Combustion systems are widely employed throughout society. There is a continual effort to improve the efficiency and reduce harmful emissions of combustion systems.

SUMMARY

Lifting a flame base to provide an increased entrainment length before the onset of combustion has been found by the inventors to reduce oxides of nitrogen (NOx) emissions.

Lifting a flame base while maintaining inherent flame stability has proven challenging.

According to an embodiment, a lifted flame burner includes a primary fuel source configured to support a primary combustion reaction, a secondary fuel source configured to support a secondary combustion reaction, a bluff body configured to hold the secondary combustion reaction, and a lifted flame holder disposed farther away from the primary and secondary fuel sources relative to the bluff body and aligned to be at least partially immersed in the secondary combustion reaction when the secondary combustion reaction is held by the bluff body. An electrically-powered primary combustion reaction actuator is configured to control exposure of a secondary fuel flow from the secondary fuel source to the primary combustion reaction. The electrically-powered primary combustion reaction actuator is configured to reduce or eliminate exposure of the secondary fuel flow to the primary combustion reaction when the electrically-powered primary combustion reaction actuator is activated.

According to another embodiment, a method for operating a lifted flame burner includes supporting a primary combustion reaction to produce an ignition source proximate to a bluff body, providing a secondary fuel stream to impinge on the bluff body, and igniting the secondary fuel stream to produce a secondary combustion reaction. The primary combustion reaction is electrically actuated to remove or reduce effectiveness of the primary combustion reaction as an ignition source proximate to the bluff body. The secondary combustion reaction is allowed to lift and be held by a lifted flame holder. The secondary fuel stream is diluted in a region between the bluff body and the lifted flame holder. Responsive to an interruption in electrical power, the secondary combustion reaction is held by the bluff body.

According to another embodiment, a method for controlling combustion can include selectively applying power to a primary combustion reaction or pilot flame actuator, and selectively applying ignition to a secondary combustion reaction with the primary combustion reaction or pilot flame as a function of the selective application of power to the primary combustion reaction or pilot flame actuator.

According to another embodiment, a combustion control gain apparatus includes a first fuel source configured to support a pilot flame or primary combustion reaction, a pilot flame or primary combustion reaction actuator configured to select a primary combustion reaction or pilot flame deflection, and a secondary fuel source. The pilot flame or primary combustion reaction deflection is selected to control a secondary fuel ignition location.

According to another embodiment, a combustion control gain apparatus includes a first fuel source configured to support a pilot flame or primary combustion reaction, a pilot flame or primary combustion reaction actuator configured to select a primary combustion reaction or pilot flame deflection, and a secondary fuel source. The pilot flame or primary combustion reaction deflection is selected to control a non-ignition location where the secondary fuel is not ignited. A bluff body corresponds to a secondary fuel ignition location when the primary combustion reaction or pilot flame is not deflected. A lifted flame holder corresponds to a secondary fuel ignition location when the primary combustion reaction or pilot flame is deflected.

DETAILED DESCRIPTION

Figure 1A:
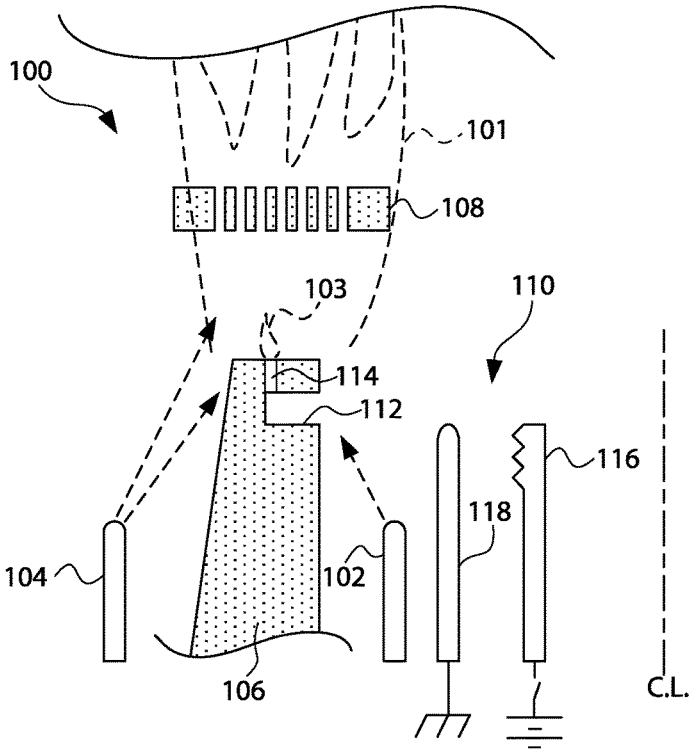
FIG. 1A is a diagram of a burner including a lifted flame holder in a state where a secondary flame is anchored to a bluff body below the lifted flame holder, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Figure 1B:
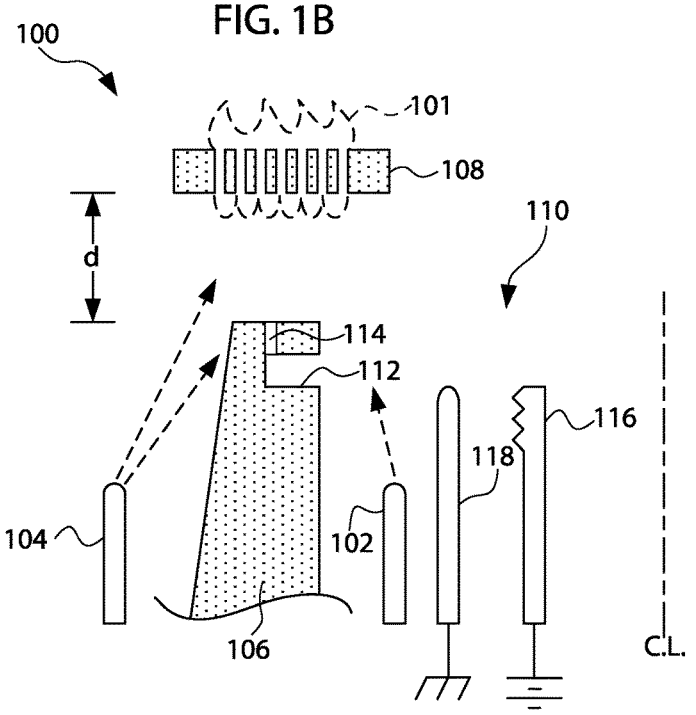
FIG. 1B is a diagram of the burner including the lifted flame holder of FIG. 1A in a state where the secondary flame is anchored to the lifted flame holder above the bluff body, according to an embodiment.

FIG. 1A is a side-sectional diagram of a portion of a burner 100 including a lifted flame holder 108 in a state where a secondary flame (also referred to as a secondary combustion reaction) 101 is anchored to a bluff body 106 below the lifted flame holder 108, according to an embodiment. FIG. 1B is a side-sectional diagram of the portion of the burner 100 including the lifted flame holder 108 in a state where the secondary flame 101 is anchored to the lifted flame holder 108 above the bluff body 106, according to an embodiment. In the pictured embodiment, the lifted flame holder 108 and the bluff body 106 are toroidal in shape. Only one side of the burner is shown, the other side being a substantial mirror image.

The lifted flame burner 100 includes a primary fuel source 102 configured to support a primary combustion reaction 103. A secondary fuel source 104 is configured to support a secondary combustion reaction 101, and includes a groove 112 that extends around the inner surface of the bluff body, and a plurality of holes 114 that exit at the top of the bluff body. The bluff body 106 is configured to hold the secondary combustion reaction 101. The lifted flame holder 108 is disposed farther away from the primary and secondary fuel sources 102, 104 relative to the bluff body 106 and aligned to be at least partially immersed in the secondary combustion reaction 101 when the secondary combustion reaction is held by the bluff body 106.

An electrically-powered primary combustion reaction actuator 110 can be configured to control exposure of a secondary fuel flow from the secondary fuel source 104 to the primary combustion reaction 103. The electrically-powered primary combustion reaction actuator 110 can be configured to reduce or eliminate exposure of the secondary fuel flow to the primary combustion reaction 103 when the electrically-powered primary combustion reaction actuator 110 is activated. Similarly, the electrically-powered primary combustion reaction actuator 110 can be configured to cause or increase exposure of the secondary fuel flow to the primary combustion reaction 103 when the electrically-powered primary combustion reaction actuator 110 is not activated. For example, the electrically-powered primary combustion reaction actuator 110 can be configured as an electrically-powered primary combustion reaction deflector 110. The electrically-powered primary combustion reaction deflector 110 is configured to deflect momentum or buoyancy of the primary combustion reaction 103 when the electrically-powered primary combustion reaction deflector 110 is activated.

According to an embodiment, the deflected momentum or buoyancy of the primary combustion reaction 103 caused by the activated primary combustion reaction deflector 110 can be selected to cause the secondary combustion reaction to lift from being held by the bluff body 106 to being held by the lifted flame holder 108. Additionally and/or alternatively, the electrically-powered primary combustion reaction deflector 110 can be configured to deflect the primary combustion reaction 103 away from a stream of secondary fuel output by the secondary fuel source 104 when the electrically-powered primary combustion reaction deflector 110 is activated. The deflection of the primary combustion reaction 103 away from the stream of secondary fuel can be selected to delay ignition of the secondary fuel.

Figure 2:
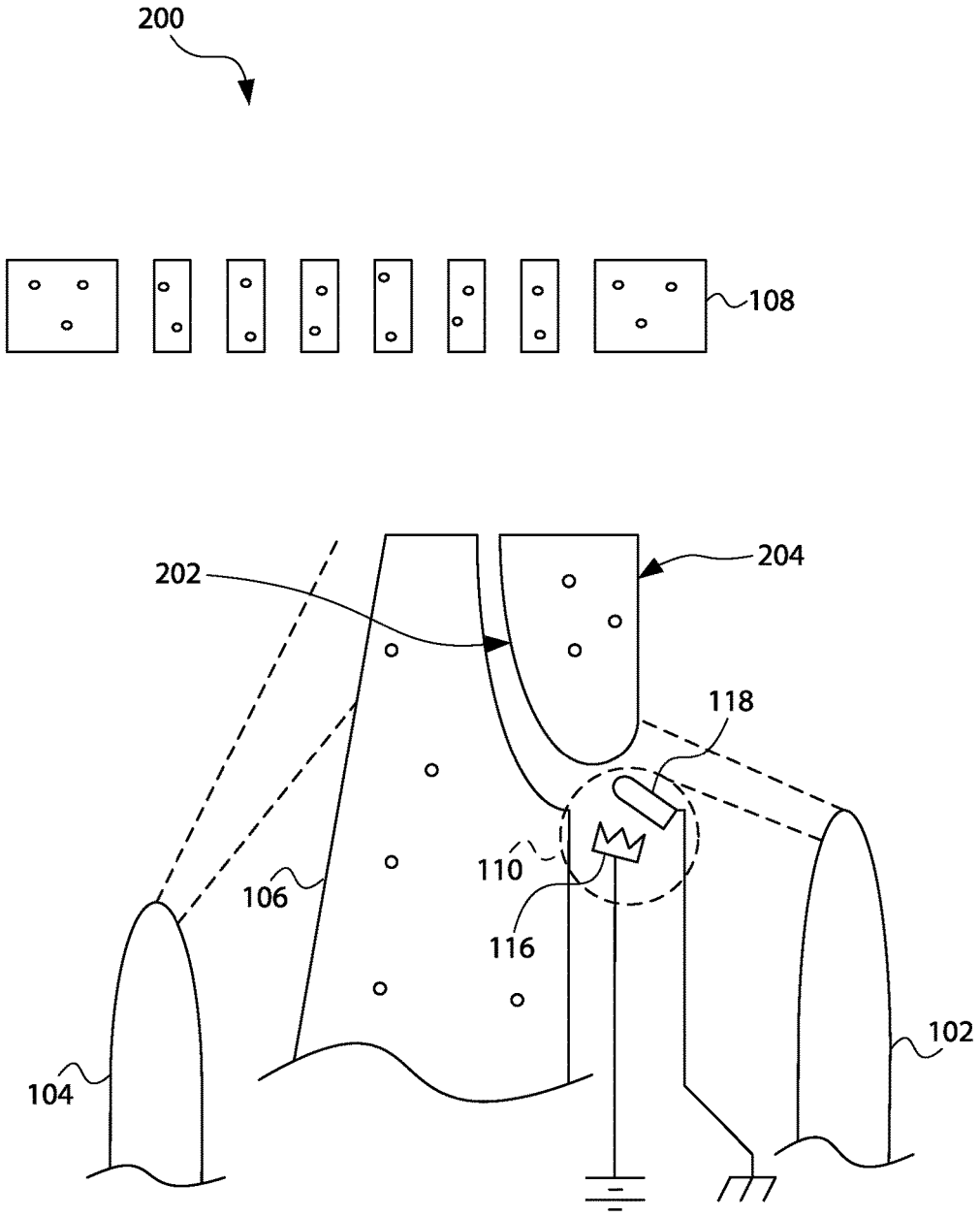
FIG. 2 is a side-sectional diagram of a burner including coanda surfaces along which a primary combustion reaction may flow responsive to deflection or non-deflection of the primary combustion reaction, according to an embodiment.

FIG. 2 is a side-sectional diagram of a burner 200 including coanda surfaces 202, 204 along which a primary combustion reaction can flow, according to an embodiment. The burner 200 includes a bluff body 106. The bluff body 106 includes the two coanda surfaces 202, 204.

A primary fuel source 102 is aligned to cause the primary combustion reaction to occur substantially along the first coanda surface 202 when the electrically-powered primary combustion reaction deflector 110 is not activated. The electrically-powered primary combustion reaction deflector 110 is configured to cause the primary combustion reaction to occur substantially along the second coanda surface 204 when the electrically-powered primary combustion reaction deflector 110 is activated.

According to an embodiment, the first coanda surface 202 is aligned to cause the primary combustion reaction to cause ignition of the secondary fuel substantially coincident with the bluff body 106. The second coanda surface 204 is aligned to cause the primary combustion reaction to cause ignition of the secondary fuel between the bluff body 106 and the lifted flame holder 108. Additionally or alternatively, the second coanda surface 204 can be aligned to cause the primary combustion reaction to cause ignition of the secondary fuel substantially coincident with the lifted flame holder 108. Additionally or alternatively, the second coanda surface 204 can be aligned to cause the primary combustion reaction or products from the primary combustion reaction to combine with the secondary combustion reaction without causing ignition of the secondary combustion reaction.

Referring to FIGS. 1A, 1B, and 2, the electrically-powered primary combustion reaction deflector 110 can include an ionic wind device (as illustrated). The ionic wind device includes a charge-ejecting electrode such as a corona electrode (also referred to as a serrated electrode) 116. According to an embodiment, the serrated electrode 116 is configured to be held at between 15 kilovolts and 50 kilovolts when the electrically-powered primary combustion reaction deflector 110 is activated. The ionic wind device also includes a smooth electrode 118. The smooth electrode 118 is configured to be held at or near electrical ground (at least) when the electrically-powered primary combustion reaction deflector 110 is activated. The ionic wind device is preferably disposed in a region of space characterized by a temperature below the primary combustion reaction temperature. Keeping the ambient temperature around or the surface temperature of the charge-ejecting electrode 116 relatively low was found by the inventors to improve the rate of charge ejection at a given voltage. The charge ejection voltage can be determined according to Peek's Law.

A lifting distance d from the bluff body 106 to at least a portion of the lifted flame holder 108 can be selected to cause partial premixing of the secondary combustion reaction when the secondary combustion reaction is held by the lifted flame holder 108. The lifting distance d from the bluff body 106 to at least a portion of the lifted flame holder 108 can be selected to cause the combination of the primary combustion reaction and the secondary combustion reaction to output reduced oxides of nitrogen (NOx) when the secondary combustion reaction is held by the lifted flame holder 108. For example, the lifting distance d can be selected to cause the stream of secondary fuel output by the secondary fuel source 104 to entrain sufficient air to result in the secondary combustion reaction being at about 1.3 to 1.5 times a stoichiometric ratio of oxygen to fuel.

According to an embodiment, the lifting distance d can be about 4.25 inches. Greater lifting distance d can optionally be selected by providing a lifted flame holder support structure (not shown) configured to hold the lifted flame holder 108 at a greater height above the bluff body 106. The lifted flame holder support structure can itself be supported from the bluff body 106 or a furnace floor (not shown).

According to an embodiment, the electrically-powered primary combustion reaction actuator 110 is configured to cause the secondary flame 101 to be reduced in height when the electrically-powered primary combustion reaction actuator 110 is activated compared to the secondary flame height when the electrically-powered primary combustion reaction actuator 110 is not activated.

The primary fuel nozzle is aligned to cause the secondary combustion reaction to be ignited by the primary combustion reaction when the primary combustion reaction actuator 110 is not actuated. The primary fuel combustion reaction can be held by the bluff body 106 when the electrical power is turned off or fails.

In other words, according to this embodiment, as long as electrical power is present in the system, the primary combustion reaction deflector 110 remains energized and operates to prevent the primary combustion reaction 103 from igniting the secondary combustion reaction 101 in the region of the bluff body 106. This permits the secondary combustion reaction 101 to be held instead by the lifted flame holder 108. However, in the event of a loss of power, the primary combustion reaction deflector 110 no longer acts on the primary combustion reaction 103, which, because of the alignment of the primary fuel nozzle 102 ignites the fuel from the secondary fuel source 104 and causing the the secondary combustion reaction to be held by the bluff body 106.

Figure 3:
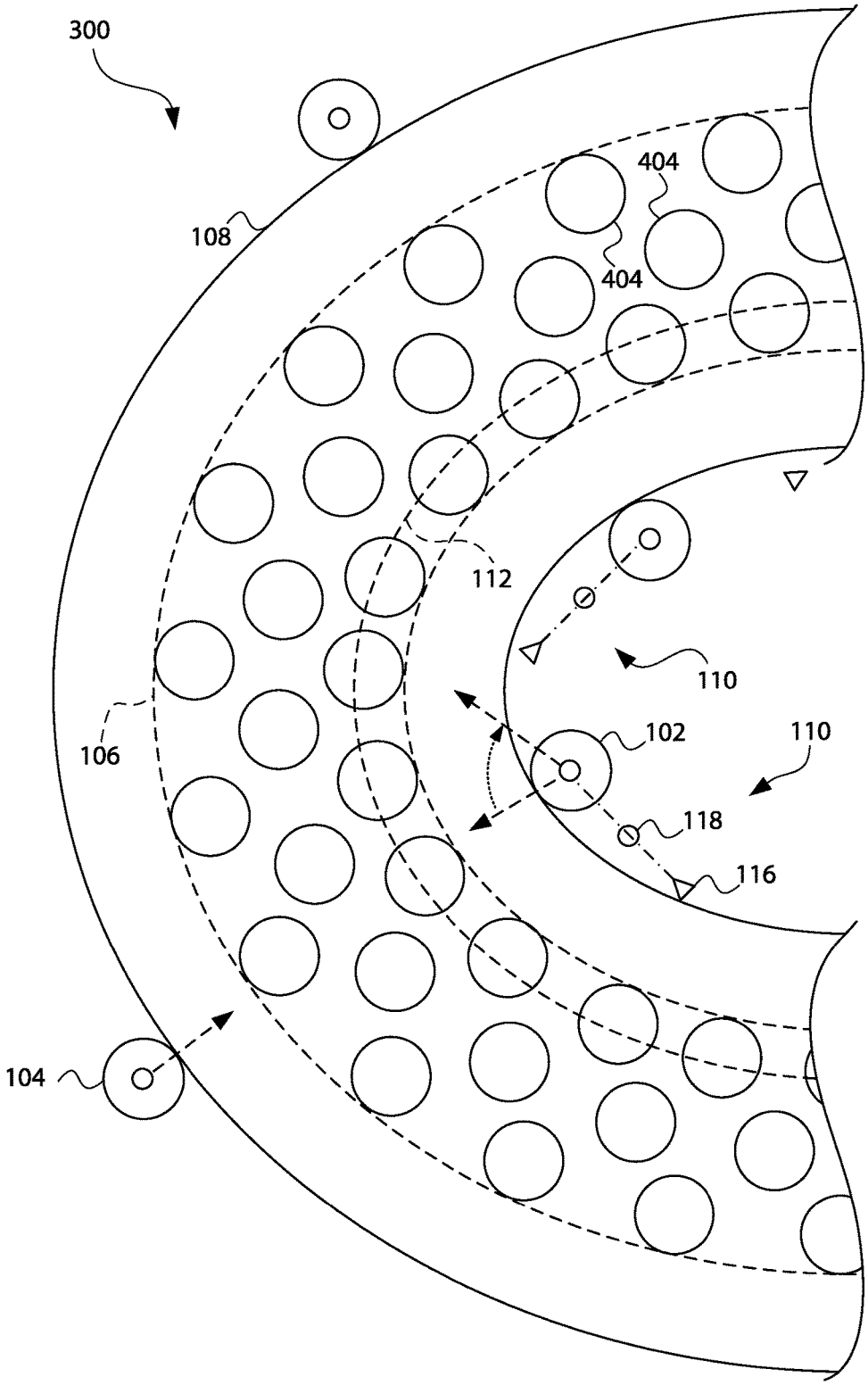
FIG. 3 is a top view of a burner including a lifted flame holder wherein a primary combustion reaction actuator includes an ionic wind device, according to an embodiment.

FIG. 3 is a top view of a burner 300 including a lifted flame holder 108, a bluff body 106—positioned behind the lifted flame holder in the view of FIG. 3 and shown in hidden lines—and a primary combustion reaction deflector 110 that includes an ionic wind device, according to an embodiment. The lifted flame holder 108 and the bluff body 104 can each have a toroid shape, a portion of which is shown in FIG. 3. The ionic wind device includes a charge ejecting electrode (such as a serrated electrode) 116 configured to be held at a high voltage and a smooth electrode 118 configured to be held at or near voltage ground. The serrated electrode 116 and the smooth electrode 118 define a line or a plane that intersects the primary fuel source 102. When energized, the charge ejecting electrode 116 ejects ions that are strongly attracted toward the counter-charged smooth electrode 118. Ions moving from the charge electrode 116 toward the smooth electrode 118 entrain air, which moves along the same path. Although most of the ions contact the smooth electrode and discharge, the entrained air, i.e., ionic wind, continues along the same path toward the primary fuel source 102 and the primary combustion reaction supported thereby. The primary combustion reaction is in turn entrained or carried by the movement of air to circulate in a groove 112 formed in an interior surface of the toroidal bluff body 106, preventing the primary combustion reaction from entering holes in the bluff body 106. When power is removed from the ionic wind device, the primary combustion reaction is no longer deflected by air moving laterally along the bluff body 106, and is thus permitted to emerge through a plurality of holes 114 in a top surface of the bluff body 106 when the electrically-powered primary combustion reaction deflector 110 is not activated.

The burner 300 includes a plurality of primary fuel sources 102, secondary fuel sources 104, and primary combustion reaction deflectors 110 distributed evenly around the bluff body 106, as shown in part in FIG. 3. The pluralities of elements are preferably configured to operate in concert with each other, for more effective operation. For example, each of the primary combustion reaction deflectors 110 is oriented in the same direction (facing clockwise, as viewed from above in the example of FIG. 3), and energized simultaneously. Thus, air movement in the groove 112 produced by an ionic wind generated by one of the plurality of primary combustion reaction deflectors 110 reinforces air movement generated by others of the plurality, which increases the effectiveness of each of the devices.

Figure 4:
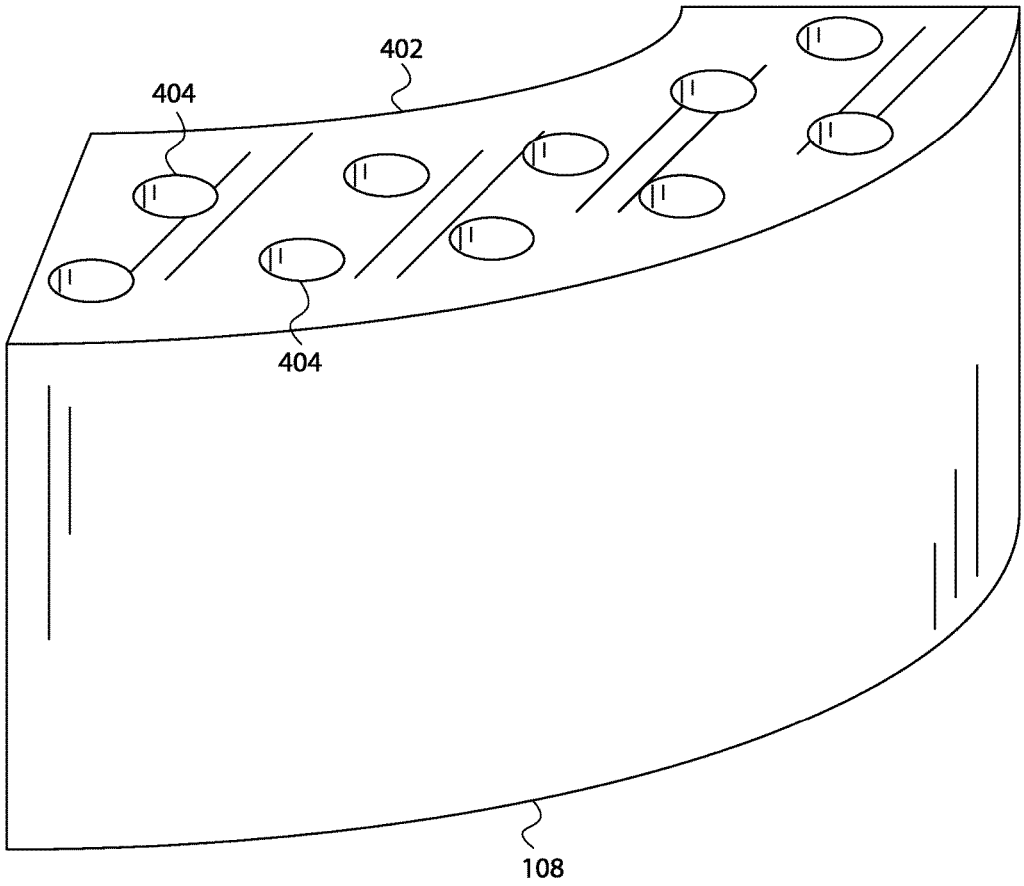
FIG. 4 is a diagram of a lifted flame holder, according to an embodiment.

FIG. 4 is a diagram of a lifted flame holder 108, according to an embodiment. The lifted flame holder 108 of FIG. 4 includes a volume of refractory material 402. The volume of refractory material 402 can be selected to allow the secondary combustion reaction to occur at least partially within a plurality of partially bounded passages 404 extending through the flame holder 108. The plurality of partially bounded passages 404 includes a plurality of vertically-aligned cylindrical voids through the refractory material 402. The refractory material 402 can be formed in a toric shape or as a section of a toric shape (as shown), for example. The lifted flame holder 108 can be about two to three inches thick, for example. The bounded passages 404 were formed by drilling the cylindrical voids through the refractory material. The inventors used drill bits ranging from ⅜ inch to about ¾ inch to drill the cylindrical voids, according to various embodiments. The inventors contemplate various alternative ways to form the lifted flame holder 108 and the cylindrical voids. For example, the cylindrical voids can be cast in place.

Figure 5:
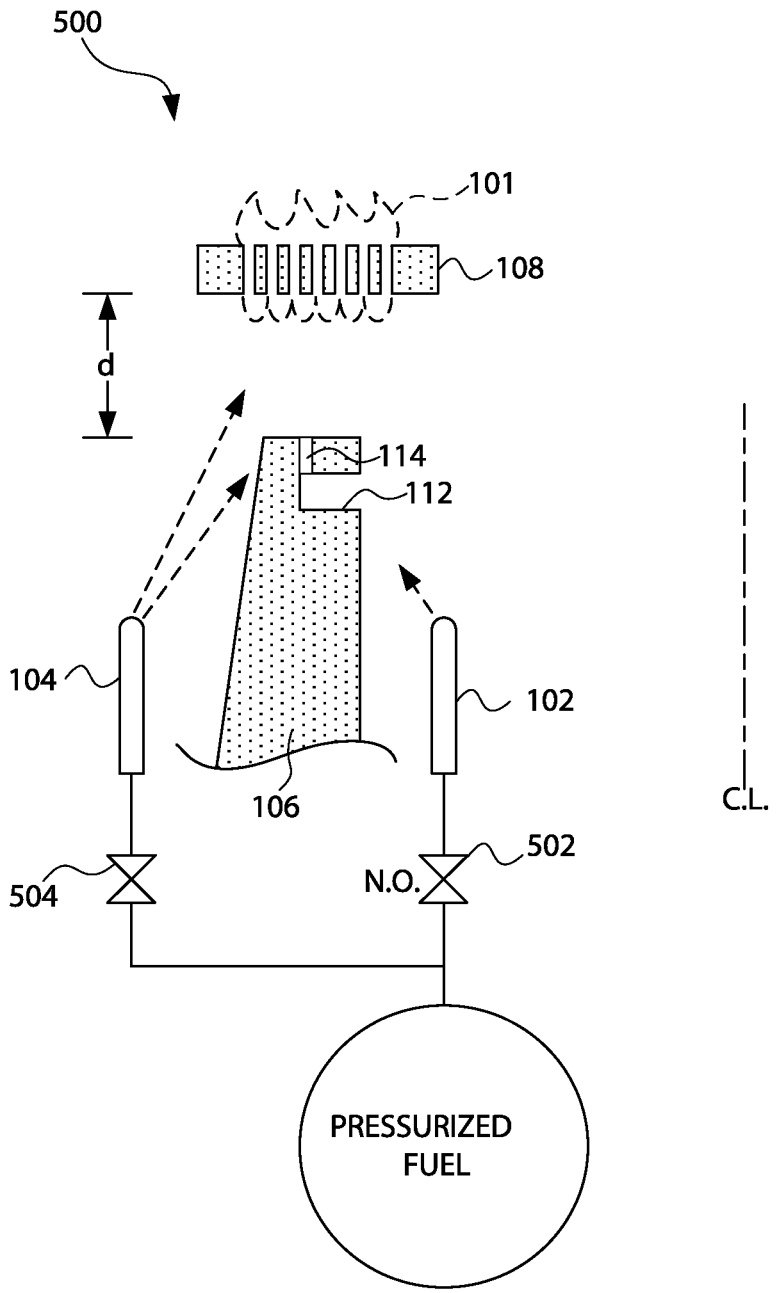
FIG. 5 is a diagram of a burner including a lifted flame holder, according to another embodiment.

FIG. 5 is a diagram of a burner 500 that includes a lifted flame holder 108, according to an embodiment. According to the embodiment, the electrically-powered primary combustion reaction actuator 110 includes a primary combustion reaction control valve 502 and a secondary combustion reaction control valve 504. The primary combustion reaction control valve 502 is preferably configured as a normally-open valve that is actuated to a reduced flow rate when electrical power is applied to the control valve. Optionally, the primary combustion reaction control valve 502 can be closed when the secondary combustion reaction is held by the lifted flame holder 108.

Figure 6:
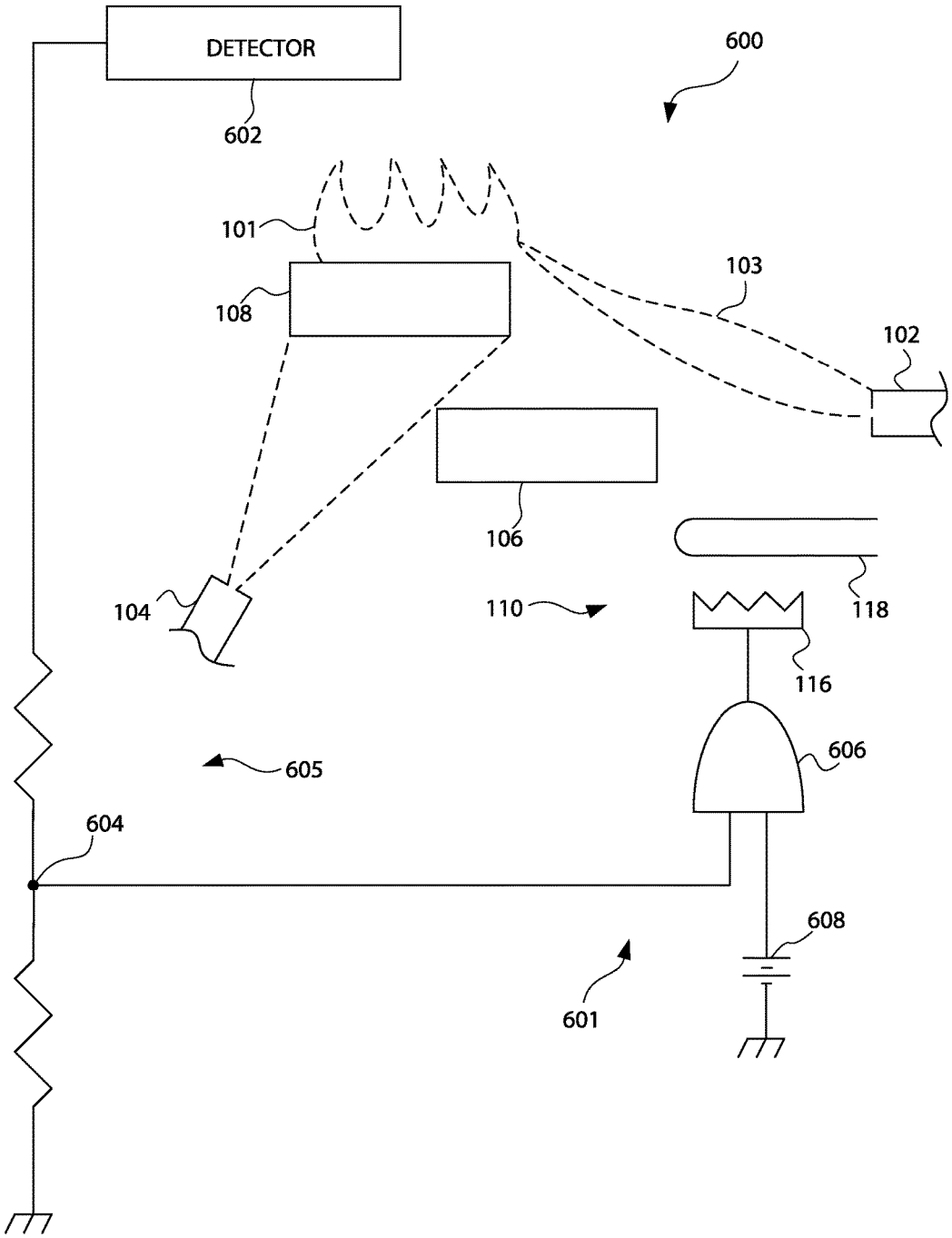
FIG. 6 is a block diagram of a burner including a lifted flame holder and a feedback circuit configured to sense operation of the lifted flame holder, according to an embodiment.

FIG. 6 is a block diagram of a burner 600 including a lifted flame holder 108 and a feedback circuit 601 configured to sense operation of the lifted flame holder, according to an embodiment. The feedback circuit 601 is configured to sense the presence or absence of a secondary combustion reaction at the lifted flame holder 108. The feedback circuit 601 is configured to interrupt electrical power to the electrically-actuated primary combustion reaction 110 when the secondary combustion reaction is not held by the lifted flame holder 108. Additionally and/or alternatively, the feedback circuit 600 can be configured to interrupt electrical power to the electrically-powered primary combustion reaction actuator 110 when the lifted flame holder 108 is damaged or fails.

According to an embodiment, the feedback circuit 601 includes a detection electrode 602. The detection electrode 602 is configured to receive an electrical charge imparted onto the secondary combustion reaction by the electrically-powered primary combustion reaction actuator 110 and/or a combustion reaction charge source, and to produce a voltage signal that corresponds to a value of the received charge. A node 604 of a voltage divider 605 is operatively coupled to the detection electrode 602, and is configured to provide a voltage that is proportional to the voltage signal produced by the detector 602, which is thus indicative of the presence or absence of a secondary combustion reaction 101 held by the lifted flame holder 108.

A logic circuit 606 is operatively coupled to the sensor 604, and is configured to cause application of a voltage from a voltage source 608 to the primary combustion reaction actuator 110 while a voltage signal is present at the node 604. A loss of the voltage signal from the detection electrode 602 causes the voltage at the node 604 to drop, in response to which the logic circuit 606 interrupts electrical power to the electrically-powered primary combustion reaction actuator 110. The actuator 110, in turn, stops deflecting the primary combustion reaction 103, which begins to ignite the secondary combustion reaction 101 at the bluff body 106.

Figure 7:
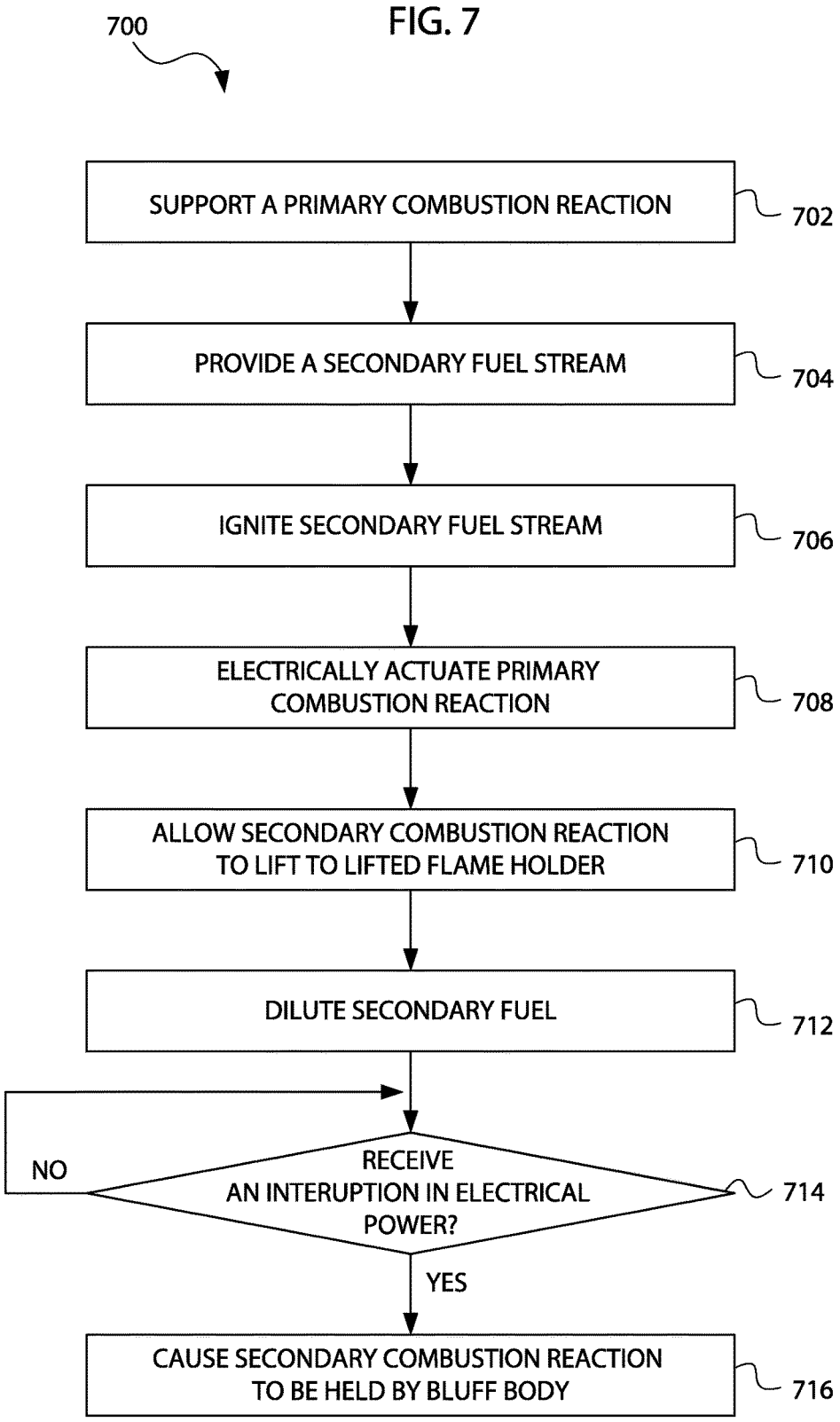
FIG. 7 is a flow chart depicting a method for operating a burner including a primary combustion reaction actuator configured to select a secondary combustion location, according to an embodiment.

FIG. 7 is a flow chart depicting a method 700 for operating a burner including a primary combustion reaction actuator configured to select a secondary combustion location, according to an embodiment.

The method 700 for operating a lifted flame burner can include step 702, in which a primary combustion reaction is supported to produce an ignition source proximate to a bluff body. In step 704, a secondary fuel stream is provided to impinge on the bluff body. Proceeding to step 706, the secondary fuel stream is ignited to produce a secondary combustion reaction. In step 708, the primary combustion reaction is electrically actuated to remove or reduce effectiveness of the primary combustion reaction as an ignition source proximate to the bluff body. Proceeding to step 710, the secondary combustion is allowed to lift and be held by a lifted flame holder.

In step 712 the secondary fuel stream is diluted in a region between the bluff body and the lifted flame holder. Diluting the secondary fuel stream in the region between the bluff body and the lifted flame holder can cause the lifted secondary combustion reaction to occur at a lower temperature than the secondary combustion reaction held by the bluff body. Additionally and/or alternatively, diluting the secondary fuel stream in the region between the bluff body and the lifted flame holder can cause the lifted secondary combustion reaction to output reduced oxides of nitrogen (NOx) compared to the secondary combustion reaction when held by the bluff body. Diluting the secondary fuel stream in the region between the bluff body and the lifted flame holder can also cause the lifted secondary combustion reaction to react to substantial completion within a reduced overall secondary combustion flame height, as compared to the secondary combustion reaction when held by the bluff body.

Referring to step 708, in which the primary combustion reaction is electrically actuated to remove or reduce effectiveness of the primary combustion reaction as an ignition source proximate to the bluff body, step 708 can include deflecting the primary combustion reaction. The primary combustion reaction can be deflected, for example, with an ionic wind generator.

Deflecting the primary combustion reaction with an ionic wind generator can include moving the primary combustion reaction from a first coanda surface to a second coanda surface. Additionally and/or alternatively, deflecting the primary combustion reaction with an ionic wind generator can include directing the primary combustion reaction along a groove in the bluff body. Deflecting the primary combustion reaction with an ionic wind generator preferably includes reducing output of the primary combustion reaction through holes formed in the bluff body.

Referring to step 708, removing or reducing effectiveness of the primary combustion reaction as an ignition source proximate to the bluff body can include reducing fuel flow to the primary combustion reaction.

The method 700 can include step 714, in which an interruption in electrical power to the primary combustion reaction actuator is received. Proceeding to step 716, in response to the interruption in electrical power, the secondary combustion reaction is caused to be held by the bluff body.

Referring to FIGS. 1A-7, the method 700 for controlling combustion can include selectively applying power to a primary combustion reaction or pilot flame actuator. Additionally and/or alternatively, the method 700 can include selectively applying ignition to a secondary combustion reaction with the primary combustion reaction or pilot flame as a function of the selective application of power to the primary combustion reaction or pilot flame actuator.

According to an embodiment, a combustion control gain apparatus can include a first fuel source. The first fuel source may be configured to support a pilot flame or primary combustion reaction.

The combustion control gain apparatus includes a pilot flame or a primary combustion reaction actuator 110. The pilot flame or primary combustion reaction actuator 110 is configured to select a primary combustion reaction or pilot flame deflection. Additionally, a secondary fuel source 104 is included. The pilot flame or primary combustion reaction deflection is selected to control a secondary fuel ignition location.

Additionally and/or alternatively, the pilot flame or primary combustion reaction deflection can be selected to control a non-ignition location where the secondary fuel is not ignited.

A bluff body 106 can include a secondary fuel ignition location when the primary combustion reaction 103 or pilot flame is not deflected.

A lifted flame holder 108 can correspond to a secondary fuel ignition location when the primary combustion reaction 103 or pilot flame is deflected.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A lifted flame burner, comprising:

a primary fuel source configured to support a primary combustion reaction;

a secondary fuel source configured to support a secondary combustion reaction;

a bluff body configured to hold the secondary combustion reaction, the bluff body being positioned adjacent to the primary and secondary fuel sources;

a lifted flame holder disposed farther away from the primary and secondary fuel sources relative to the bluff body and aligned to be at least partially immersed in the secondary combustion reaction when the secondary combustion reaction is held by the bluff body; and a combustion reaction actuator configured to control exposure of a secondary fuel flow from the secondary fuel source to the primary combustion reaction;

wherein, when activated, the combustion reaction actuator is configured to reduce or eliminate exposure of a secondary fuel flow to the primary combustion reaction.

2. The lifted flame burner of claim 1, wherein the combustion reaction actuator is configured to reduce or eliminate exposure of a secondary fuel flow to the primary combustion reaction only when activated.

3. The lifted flame burner of claim 1, wherein the combustion reaction actuator includes a combustion reaction deflector configured to deflect momentum of the primary combustion reaction when the combustion reaction deflector is activated.

4. The lifted flame burner of claim 3, wherein the deflection of momentum of the primary combustion reaction by the combustion reaction deflector is sufficient to cause the secondary combustion reaction to lift from being held by the bluff body to being held by the lifted flame holder.

5. The lifted flame burner of claim 3, wherein the combustion reaction deflector is configured to deflect the primary combustion reaction away from a stream of fuel output by the secondary fuel source when the combustion reaction deflector is activated.

6. The lifted flame burner of claim 5, wherein deflection of the primary combustion reaction away from the stream of fuel output by the secondary fuel source delays ignition of the secondary fuel.

7. The lifted flame burner of claim 3, wherein the bluff body includes two coanda surfaces;

wherein the primary fuel source is aligned to cause the primary combustion reaction to occur substantially along the first coanda surface; and wherein the combustion reaction deflector is configured to disable occurrence of the primary combustion reaction substantially along the first coanda surface, and to cause the primary combustion reaction to occur substantially along the second coanda surface when the combustion reaction deflector is activated.

8. The lifted flame burner of claim 7, wherein the first coanda surface is aligned such that when the primary combustion reaction occurs along the first coanda surface, the primary combustion reaction ignites a stream of fuel output by the secondary fuel source substantially coincident with the bluff body.

9. The lifted flame burner of claim 7, wherein the second coanda surface is aligned to cause the primary combustion reaction to ignite a stream of fuel output by the secondary fuel source between the bluff body and the lifted flame holder.

10. The lifted flame burner of claim 7, wherein the second coanda surface is aligned to cause the primary combustion reaction to ignite a stream of fuel output by the secondary fuel source substantially coincident with the lifted flame holder.

11. The lifted flame burner of claim 3, wherein the combustion reaction deflector comprises an ionic wind device.

12. The lifted flame burner of claim 11, wherein the ionic wind device includes a serrated electrode configured to be held at 15 kilovolts to 50 kilovolts when the combustion reaction deflector is activated.

13. The lifted flame burner of claim 11, wherein the ionic wind device includes a smooth electrode configured to be held near ground when the combustion reaction deflector is activated.

14. The lifted flame burner of claim 11, wherein the ionic wind device is disposed in a region of space characterized by a temperature below that of the primary combustion reaction.

15. The lifted flame burner of claim 11, wherein the ionic wind device further comprises:

a serrated electrode configured to be held at a high voltage; and a smooth electrode configured to be held at or near voltage ground; and wherein the serrated electrode and the smooth electrode define a line or a plane that also intersects the primary fuel source.

16. The lifted flame burner of claim 3, wherein the combustion reaction deflector is configured to cause the primary combustion reaction to circulate in a groove when the combustion reaction deflector is activated.

17. The lifted flame burner of claim 3, wherein the bluff body is configured to direct the primary combustion reaction to emerge through a plurality of holes 114 in a top surface of the bluff body.

18. The lifted flame burner of claim 3, wherein the lifted flame holder comprises a volume of refractory material configured to hold the secondary combustion reaction at least partially within a plurality of partially bounded passages formed through the refractory material.

19. The lifted flame burner of claim 3, wherein the plurality of partially bounded passages includes a plurality of vertically-aligned cylindrical voids through the refractory material.

20. The lifted flame burner of claim 1, wherein the combustion reaction actuator includes a primary combustion reaction control valve.

21. The lifted flame burner of claim 20, wherein the primary combustion reaction control valve includes a normally-open valve that is configured to actuate to a reduced flow rate when electrical power is applied to the control valve.

22. The lifted flame burner of claim 1, wherein a distance between the bluff body and the lifted flame holder is sufficient to enable partial premixing of a stream of fuel output by the secondary fuel source when the secondary combustion reaction is held by the lifted flame holder.

23. The lifted flame burner of claim 1, wherein the combustion reaction actuator is electrically powered.

24. The lifted flame burner of claim 1, wherein a distance between the bluff body and the lifted flame holder is about 5.25 inches.

25. The lifted flame burner of claim 1, wherein a distance between the bluff body and the lifted flame holder is such that an oxygen to fuel ratio of a stream of fuel output by the secondary fuel source is at about 1.3 to 1.5 times a stoichiometric ratio of oxygen to fuel when the stream reaches the lifted flame holder.

26. The lifted flame burner of claim 1, wherein the combustion reaction actuator is configured to cause the secondary flame to reduce in height when the combustion reaction actuator is activated.

27. The lifted flame burner of claim 1, wherein the primary fuel source includes a nozzle aligned to cause a stream of fuel output by the secondary fuel source to be ignited by the primary combustion reaction and to support the secondary combustion reaction held by the bluff body when electrical power to the combustion reaction actuator is removed.

28. The lifted flame burner of claim 1, further comprising:

a feedback circuit configured to detect the secondary combustion reaction held by the lifted flame holder, and to interrupt electrical power to the combustion reaction actuator when the secondary combustion reaction is not detected.

29. The lifted flame burner of claim 1, further comprising:

a feedback circuit configured to detect the secondary combustion reaction held by the lifted flame holder, and to interrupt electrical power to the combustion reaction actuator when the lifted flame holder is damaged or fails.

30. The lifted flame burner of claim 1, further comprising:

a feedback circuit configured to detect the secondary combustion reaction, held by the lifted flame holder;

wherein the feedback circuit includes:

a detection electrode configured to produce a first voltage signal corresponding to a value of an electrical charge imparted onto the secondary combustion reaction by a combustion reaction charge source;

a sensor node operatively coupled to the detection electrode and configured to hold a second voltage signal corresponding to the first voltage signal; and a logic circuit operatively coupled to the sensor node and configured to control application of a third voltage signal to the combustion reaction actuator according to a value of the second voltage signal.

31. The lifted flame burner of claim 30, wherein the feedback circuit is configured to interrupt electrical power to the combustion reaction actuator in the absence of the electrical charge.

32. A method for operating a lifted flame burner, comprising:

producing an ignition source proximate to a bluff body by supporting a primary combustion reaction;

providing a secondary fuel stream to impinge on the bluff body;

producing a secondary combustion reaction by igniting the secondary fuel stream with the primary combustion reaction;

removing or reducing effectiveness of the primary combustion reaction as an ignition source by electrically actuating the primary combustion reaction;

diluting the secondary fuel stream in a region between the bluff body and the lifted flame holder; and holding the secondary combustion with a lifted flame holder.

33. The method for operating a lifted flame burner of claim 32, wherein diluting fuel stream in the region between the bluff body and the lifted flame holder causes the lifted secondary combustion reaction to occur at a lower temperature than combustion reaction held by the bluff body.

34. The method for operating a lifted flame burner of claim 32, wherein diluting fuel stream in the region between the bluff body and the lifted flame holder causes the lifted secondary combustion reaction to output reduced oxides of nitrogen (NOx) compared to combustion reaction held by the bluff body.

35. The method for operating a lifted flame burner of claim 32, wherein diluting fuel stream in the region between the bluff body and the lifted flame holder causes the lifted secondary combustion reaction to react to substantial completion within a reduced overall secondary combustion flame height than combustion reaction held by the bluff body.

36. The method for operating a lifted flame burner of claim 32, wherein electrically actuating the primary combustion reaction t comprises:

deflecting the primary combustion reaction.

37. The method for operating a lifted flame burner of claim 32, wherein electrically actuating the primary combustion reaction comprises:

deflecting the primary combustion reaction with an ionic wind generator.

38. The method for operating a lifted flame burner of claim 37, wherein deflecting the primary combustion reaction with an ionic wind generator includes moving the primary combustion reaction from a first coanda surface to a second coanda surface.

39. The method for operating a lifted flame burner of claim 37, wherein deflecting the primary combustion reaction with an ionic wind generator includes directing the primary combustion reaction along a groove in the bluff body.

40. The method for operating a lifted flame burner of claim 37, wherein deflecting the primary combustion reaction with an ionic wind generator includes reducing output of the primary combustion reaction through holes formed in the bluff body.

41. The method for operating a lifted flame burner of claim 32, wherein electrically actuating the primary combustion reaction comprises:

reducing fuel flow to the primary combustion reaction.

42. The method for operating a lifted flame burner of claim 32, further comprising:

receiving an interruption in electrical power to a primary combustion reaction actuator; and responsive to the interruption in electrical power, holding the secondary combustion reaction with the bluff body.

43. A combustion control gain apparatus, comprising:

a first fuel source configured to support a primary combustion reaction;

a secondary fuel source; and a combustion reaction actuator configured to selectively deflect the primary combustion reaction from a first secondary fuel ignition location to a location where the secondary fuel source is not ignited by the primary combustion reaction; and a lifted flame holder corresponding to the first secondary fuel ignition location.

44. The combustion control gain apparatus of claim 43, wherein the lifted flame holder comprises:

a bluff body corresponding to the first secondary fuel ignition location.

* * * * *